US006496349B1

(12) United States Patent
Siljeholm

(10) Patent No.: US 6,496,349 B1
(45) Date of Patent: Dec. 17, 2002

(54) STABILIZING DEVICE FOR A TRANSMISSION LINE-MOUNTED SURGE ARRESTER

(75) Inventor: Roger Siljeholm, Ludvika (SE)

(73) Assignee: ABB AB, Vasteras (SE)

( * ) Notice: Subject to any disclaimer, the term of this patent is extended or adjusted under 35 U.S.C. 154(b) by 0 days.

(21) Appl. No.: 09/821,469

(22) PCT Filed: Oct. 5, 1999

(86) PCT No.: PCT/SE99/01762

§ 371 (c)(1),
(2), (4) Date: Jul. 16, 2001

(87) PCT Pub. No.: WO00/22632

PCT Pub. Date: Apr. 20, 2000

(30) Foreign Application Priority Data

Oct. 9, 1998 (SE) ..... 9803466

(51) Int. Cl.[7] ..... H01C 7/12
(52) U.S. Cl. ..... 361/118
(58) Field of Search ..... 361/117, 118

(56) References Cited

U.S. PATENT DOCUMENTS 5,426,555 A 6/1995 Lundquist
6,356,428 B1 * 3/2002 Akervall et al. ..... 361/117

OTHER PUBLICATIONS

Patent Abstracts of Japan, JP 2–098019, Apr. 10, 1990.
Patent Abstracts of Japan, JP 1–200521, Aug. 11, 1989.

* cited by examiner

*Primary Examiner*—Shawn Riley
(74) *Attorney, Agent, or Firm*—Oblon, Spivak, McClelland, Maier & Neustadt, P.C.

(57) ABSTRACT

A line arrester, which is articulately suspended from a transmission or distribution network and on which a stabilizing device is arranged. The stabilizing device increases the mass-moment of inertia of the line arrester so as to contract movements of the line arrester deviating from the vertical line. The stabilizing device has a mass center which substantially conforms to a vertical line which passes through the mass center of the line arrester.

16 Claims, 1 Drawing Sheet

STABILIZING DEVICE FOR A TRANSMISSION LINE-MOUNTED SURGE ARRESTER

TECHNICAL FIELD

The present invention relates to a transmission line-mounted surge arrester (hereinafter referred to as line arrester) with a stabilizing device for use in air-insulated power transmission lines in high-voltage transmission or distribution networks, that is, in electric networks with voltages from a few kilovolts up to several hundred kilovolts. The present invention also relates to a method in and use of such a stabilizing device.

BACKGROUND ART

Line arresters exhibit a non-linear current-voltage characteristic in that their conductivity increases non-linearly with the voltage. Modern line arresters comprise series-connected blocks of substantially zinc oxide which are enclosed in a porcelain or polymer insulator. At normal voltages across the blocks, their conductivity is practically zero, but at high voltages the blocks become electrically conductive. To prevent overvoltages, such as switching overvoltages or overvoltages caused by lightning strokes, from propagating in air-insulated transmission lines, line arresters are connected, at regular intervals, to the conductors of the transmission line. If over-voltages reach switchgear, they may damage electrical apparatuses or force circuit breakers to trip, thus destroying large parts of the electric network.

Line arresters have an elongated shape and are electrically connected at one of their ends to one of the conductors of the transmission line and at their other end to ground potential. In a commonly occurring mounting arrangement, the line arrester is articulately suspended from a point of attachment on the transmission line. The line arrester is suspended vertically in the transmission line and is connected, at its lower end, to ground, normally via a conducting wire, so-called slack. In the following, line arrester means a line arrester which is articulately suspended from an attachment point of a transmission line. According to this mounting arrangement, the line arrester, while being influenced by external forces from, for example, wind or earthquakes, may be brought to oscillate or swing, the longitudinal axis of the line arrester thus being forced to deviate from the vertical line. Due to this deviation from the vertical line, there is a risk that the phase-to-phase and phase-to-ground distance for the transmission line falls below the prescribed smallest distance.

SUMMARY OF THE INVENTION

A first object of the presents invention is to provide a stabilizing device for a line arrester, articulately suspended from an attachment point of a transmission line, by means of which the above-mentioned problems with deviation from the vertical line may be reduced.

A second object of the present invention is to provide a method in a stabilizing device for a line arrester, articulately suspended from an attachment point of a transmission line, by means of which the above-mentioned problems with deviation from the vertical line may be reduced.

The first object according to the above is achieved by arranging at least one stabilizing device at the line arrester by means of which the mass-moment of inertia of the line arrester is increased. In order to retain the orientation of the line arrester in the vertical line, the mass centre of the stabilizing device shall substantially conform to the vertical line which passes through the mass centre of the line arrester.

When a line arrester is subjected to a wind load, the wind influences the line arrester with a torque which strives to rotate the line arrester from the vertical line. To counteract this torque, at least one stabilizing device is arranged at the line arrester and by adapting the mass of the stabilizing device, the geometrical shape and/or location of the stabilizing device at the line arrester, the mass-moment of inertia of the line arrester may be adapted to the external forces which are expected to influence the line arrester. The expected forces then depend on the location where the line arrester is mounted; for example, strong winds may be expected along coasts and in valleys. With knowledge of this, the mass-moment of inertia of the line arrester may be adapted such that the longitudinal axis of the line arrester does not deviate from the vertical line by more than a given maximum angle. In most cases, the maximum angle may be allowed to be 15° without the phase-to-phase and phase-to-ground distance falling below the prescribed minimum distance.

The mass of the stabilizing devices, the shape and/or location of the stabilizing devices at the line arrester may also be adapted to the type of line arrester at which the stabilizing device is arranged. For example, line arresters of various sizes may be caused to have the same mass-moment of inertia by individual adaptation of the stabilizing device of the respective line arrester.

According to a preferred embodiment of the invention, the stabilizing device comprises a weight which is attached to the lower end of the line arrester. By dimensioning the mass of the weight, the mass-moment of inertia of the line arrester may be adapted to the external forces which are expected to influence the line arrester. A weight with a large mass gives a greater mass-moment of inertia than a weight with a small mass and the resistance of the line arrester to deviate from the vertical line thus increases. By arranging the weight at the line arrester such that the mass centre of the weight substantially conforms to the vertical line which passes through the mass centre of the line arrester, the orientation of the line arrester in the vertical line is retained also when no wind load occurs.

By arranging the stabilizing device at the line arrester, the natural frequency of the line arrester is changed. This can be made use of for increasing the capacity of the line arrester to resist periodically recurring gusts of wind of a certain frequency. The line arrester is then arranged with at least one stabilizing device with which the mass-moment of inertia of the line arrester is adapted such that the natural frequency of the line arrester is brought to deviate from the frequency of the periodically recurring gusts of wind.

The second object according to the above is achieved by arranging the line arrester with at least one stabilizing device which increases the mass-moment of inertia of the line arrester.

BRIEF DESCRIPTION OF THE DRAWINGS

The invention will be described in greater detail in the following with reference to the accompanying figures, wherein.

DESCRIPTION OF THE PREFERRED EMBODIMENTS

Figure 1:
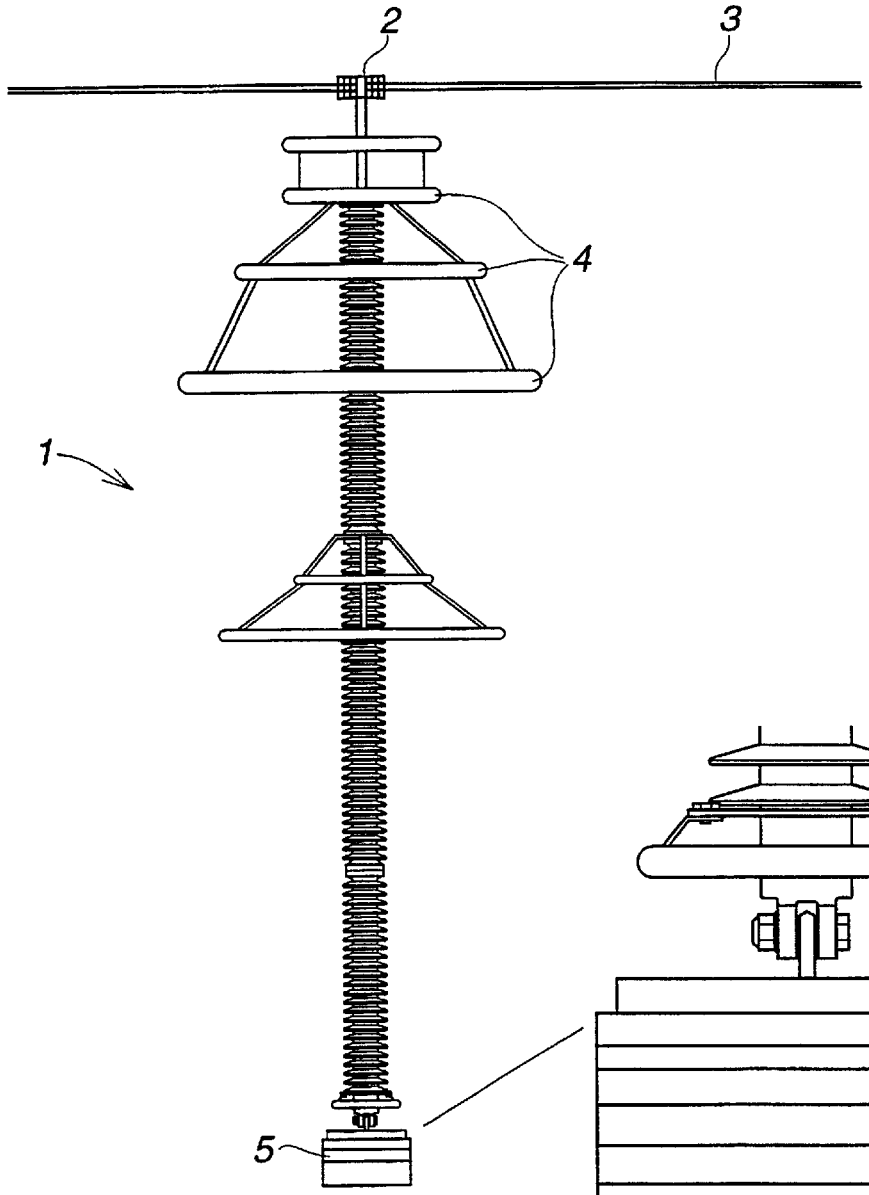
FIG. 1 shows a preferred embodiment of a stabilizing device in the form of a weight arranged on a line arrester.
Figure 2:
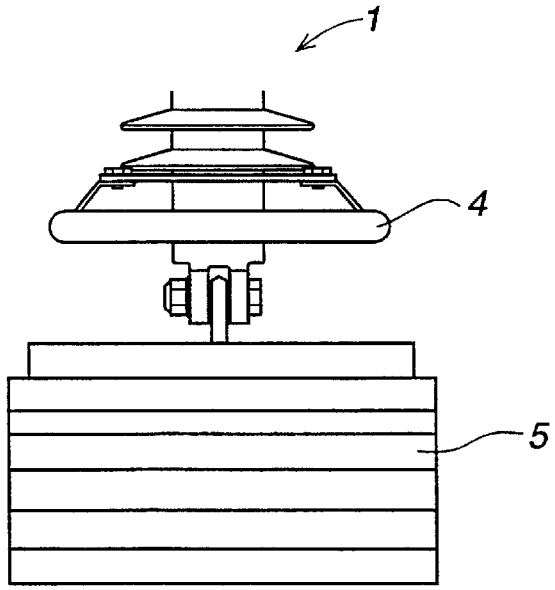
FIG. 2 shows a detailed view of the stabilizing device shown in FIG. 1.

FIG. 1 shows a line arrester 1 which is articulately suspended from a point of attachment 2 on a transmission line 3. The line arrester 1 is thus hanging perpendicularly in the transmission line 3 when it is not influenced by any external force. Corona rings 4 are arranged at the line arrester 1 to prevent partial discharges (corona) in the air around the line arrester 1. At the lower end of the line arrester 1, a stabilizing device 5 in the form of a weight is arranged. By suitably dimensioning the mass of the weight 5, the mass-moment of inertia of the line arrester 1 may be adapted to the external forces which are expected to influence the line arrester at the location where the line arrester is to be installed. The weight is arranged such that its mass centre substantially conforms to the vertical line which passes through the mass centre of the line arrester. In this way, the line arrester retains its orientation in the vertical line also when no external force, for example wind load, occurs FIG. 2 shows a detailed view of the weight 5. In the figure, the weight 5 is articulately arranged at the line arrester 1 by means of a joint 6 which is movable in a plane. The joint 6 permits a suitable weight 5 to be easily arranged at the line arrester 1.

In FIGS. 1 and 2, only one stabilizing device 5 is arranged at the line arrester 1. It is to be understood, however, that the scope of the invention, in addition to what is described above, allows for numerous different ways of arranging one or a plurality of stabilizing devices in a line arrester for the purpose of changing the mass-moment of inertia thereof.

What is claimed is:

1. A line arrester comprising a first end, in which is arranged an attachment point which allows the line arrester an oscillating movement, and a second end which is capable of swinging freely, wherein the line arrester in the second end comprises a stabilizing device which, when being externally influenced, counteracts a deviation of the line arrester from a vertical line.

2. A line arrester according to claim 1, wherein the stabilizing device comprises at least one weight.

3. A line arrester according to claim 1, wherein the stabilizing device is articulately attached to the line arrester.

4. A line arrester according to claim 2, wherein the stabilizing device is articulately attached to the line arrester.

5. A line arrester, articulately suspended from an attachment point of a transmission line, wherein the line arrester comprises a stabilizing device which is adapted to increase a mass-moment of inertia of the line arrester and to counteract a deflecting movement of the line arrester from a vertical line, caused by external stress, which stabilizing device has a mass center which substantially conforms to the vertical line which passes through the mass center of the line arrester.

6. A method in a line arrester comprising a first end, in which is arranged an attachment point which allows the line arrester an oscillating movement, and a second end which is capable of swinging freely, in order to stabilize the line arrester and to counteract oscillations in case of external influence, wherein the second end of the line arrester is brought to comprise a stabilizing device.

7. A method according to claim 5, wherein the stabilizing device is brought to comprise a weight.

8. A method in a line arrester, which is articulately suspended from an attachment point of a transmission line, for counteracting a movement deviating from a vertical line, wherein the line arrester is adapted to comprise a stabilizing device, whereby a mass-moment of inertia of the line arrester is increased, and whereby a mass center is imparted to the stabilizing device, which mass center substantially conforms to the vertical line which passes through the mass center of the line arrester.

9. Use of a line arrester according to claim 1, in one of a transmission network and a distribution network.

10. Use of a line arrester according to claim 2, in one of a transmission network and a distribution network.

11. Use of a line arrester according to claim 3, in one of a transmission network and a distribution network.

12. Use of a line arrester according to claim 4, in one of a transmission network and a distribution network.

13. Use of a line arrester according to claim 5, in one of a transmission network and a distribution network.

14. Use of a line arrester according to claim 6, in one of a transmission network and a distribution network.

15. Use of a line arrester according to claim 7, in one of a transmission network and a distribution network.

16. Use of a line arrester according to claim 8, in one of a transmission network and a distribution network.

* * * * *